US010074340B2

(12) United States Patent
Matsuda et al.

(10) Patent No.: US 10,074,340 B2
(45) Date of Patent: Sep. 11, 2018

(54) TRANSMISSION DEVICE, RECEPTION DEVICE, TRANSMISSION/RECEPTION SYSTEM, AND IMAGE DISPLAY SYSTEM AND CLOCK TRAINING THEREOF

(71) Applicant: THINE ELECTRONICS, INC., Tokyo (JP)

(72) Inventors: Hiromichi Matsuda, Tokyo (JP); Takatoshi Uchida, Tokyo (JP); Takayuki Suzuki, Tokyo (JP)

(73) Assignee: THINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 15/026,354

(22) PCT Filed: Sep. 30, 2014

(86) PCT No.: PCT/JP2014/076095
§ 371 (c)(1),
(2) Date: Mar. 31, 2016

(87) PCT Pub. No.: WO2015/050123
PCT Pub. Date: Apr. 9, 2015

(65) Prior Publication Data

US 2016/0232874 A1 Aug. 11, 2016

(30) Foreign Application Priority Data

Oct. 4, 2013 (JP) ..... 2013-209352

(51) Int. Cl.
*G09G 5/00* (2006.01)
*G09G 3/20* (2006.01)

(52) U.S. Cl.
CPC ..... *G09G 5/006* (2013.01); *G09G 3/20* (2013.01); *G09G 5/008* (2013.01);
(Continued)

(58) Field of Classification Search
None
See application file for complete search history.

(56) References Cited

U.S. PATENT DOCUMENTS

2003/0169247 A1* 9/2003 Kawabe ..... G09G 3/342 345/204
2010/0266080 A1* 10/2010 Akita ..... H04L 7/10 375/362

(Continued)

FOREIGN PATENT DOCUMENTS

CN 1387338 A 12/2002
CN 101919228 A 12/2010

(Continued)

OTHER PUBLICATIONS

Dong Hoon Baek, et al, "Late-News Paper: The Enhanced Reduced Voltage Differential Signaling (eRVDS) Interface With Clock Embedded Scheme for Chip-On-Glass TFT-LCD Applications", SID10 Digest, 2010, p. 70-p. 73.

(Continued)

*Primary Examiner* — Hilina K Demeter
(74) *Attorney, Agent, or Firm* — Sughrue Mion, PLLC

(57) ABSTRACT

A mode switching notification in a first mode is transmitted from a transmission device 10 to a reception device 20 according to a first protocol. In a second mode, training data is transmitted from the transmission device 10 to the reception device 20, clock training is performed in the reception device 20, and a mode switching notification for the first mode is transmitted from the transmission device 10 to the reception device 20 according to a second protocol simpler and faster than the first protocol.

7 Claims, 4 Drawing Sheets

(52) U.S. Cl.
CPC ... *G09G 2352/00* (2013.01); *G09G 2370/045* (2013.01); *G09G 2370/08* (2013.01); *G09G 2370/14* (2013.01)

(56) References Cited

U.S. PATENT DOCUMENTS

| | | | | |
|---|---|---|---|---|
| 2011/0242066 | A1 | 10/2011 | Jeon et al. | |
| 2011/0292024 | A1* | 12/2011 | Baek | G09G 3/2096 345/212 |
| 2013/0113777 | A1 | 5/2013 | Baek et al. | |
| 2013/0229404 | A1* | 9/2013 | Ishida | G09G 5/006 345/212 |
| 2013/0262720 | A1 | 10/2013 | Kobayashi | |
| 2014/0118235 | A1* | 5/2014 | Hong | G09G 5/008 345/87 |
| 2015/0154943 | A1* | 6/2015 | Lee | G09G 5/18 345/204 |

FOREIGN PATENT DOCUMENTS

| | | | |
|---|---|---|---|
| CN | 103106861 | A | 5/2013 |
| JP | 2001-251385 | A | 9/2001 |
| JP | 2013-500682 | A | 1/2013 |
| WO | 2005/101773 | A1 | 10/2005 |
| WO | 2010/053021 | A1 | 5/2010 |

OTHER PUBLICATIONS

Jeon-Ho Kang, Hyun-Kyu Jeon, et al, "A Clock-embedded Voltage Differential Signaling (CVDS) for the Chip-On-Glass Application of TFT-LCD", SID 10 Digest, 2010, p. 66-p. 69.

International Preliminary Report on Patentability dated Apr. 14, 2016 from the International Bureau in counterpart International Application No. PCT/JP2014/076095.

International Search Report dated Nov. 11, 2014 from the International Bureau in counterpart International Application No. PCT/JP2014/076095.

Communication dated May 9, 2017 from the European Patent Office in counterpart application No. 14850150.5.

Communication dated Feb. 24, 2018 issued by the State Intellectual Property Office of People's Republic of China in counterpart application No. 201480053989.0.

* cited by examiner

TRANSMISSION DEVICE, RECEPTION DEVICE, TRANSMISSION/RECEPTION SYSTEM, AND IMAGE DISPLAY SYSTEM AND CLOCK TRAINING THEREOF

TECHNICAL FIELD

The present invention relates to a transmission device, a reception device, a transmission/reception system, and an image display system.

BACKGROUND ART

An image display system such as a liquid crystal display system includes a transmission device, a reception device, and an image display device. A clock may be transmitted through a signal line separate from a signal line through which data is transmitted from the transmission device to the reception device or data in which the clock is embedded may be transmitted from the transmission device to the reception device (see Non Patent Literatures 1 and 2). For the data in which the clock is embedded, a timing of transition from a first level to a second level is in each unit period and information of a predetermined number of bits is provided in the unit period starting from the timing of transition. Also, one of the first and second levels is a high level and the other is a low level.

The transmission device inputs an image signal or the like from an outside and transmits image data and training data to the reception device. The reception device performs clock training on the basis of the training data received from the transmission device, samples the image data transmitted from the transmission device at a timing indicated by a clock after training, and transmits an image signal obtained by the sampling to the image display device. The image display device displays an image on the basis of the image signal transmitted from the reception device.

In an image display system such as a liquid crystal display system, generally, the above-described transmission device or a device including the transmission device is referred to as a "timing controller" and the above-described reception device or a device including the reception device is referred to as a "driver." Also, generally, a plurality of drivers are connected to one timing controller.

In a transmission/reception system including a transmission device and a reception device which transmit and receive such image data, an active period in which the image data is transmitted and received and a blank period in which no image data is transmitted or received are provided. The training data for the reception device to perform training is transmitted from the transmission device to the reception device during the blank period.

Also, in the transmission/reception system, a first signal line for transmitting the image data and the training data from the transmission device to the reception device and a second signal line for performing communication between the transmission device and the reception device are provided. Through the communication via the second signal line, the transmission device notifies the reception device of a gamma value, various types of control information, setting information for a register, and the like in the image display system, for example, such as a liquid crystal display system. The communication via the second signal line conforms to protocols of serial bus standards, for example, such as Inter-Integrated Circuit ($I^2C$) and a Serial Peripheral Interface (SPI).

CITATION LIST

Non Patent Literature

[Non Patent Literature 1] Jeong-I-Io Kang, et al, "A. Clock-embedded Voltage Differential Signaling (CVDS) for the Chip-On-Glass Application of TFT-LCD," SID 10 DIGEST, pp. 66-69 (2010).

[Non Patent Literature 2] Dong Hoon Back, et al, "Late-NewsPaper: The Enhanced Reduced Voltage Differential. Signaling (eRVDS) Interface With Clock Embedded Scheme for Chip-On-Glass TFT-LCD Applications," SID 10 DIGEST, pp. 70-73 (2010)

SUMMARY OF INVENTION

Technical Problem

In the transmission/reception system, the notification of transition. between the active period and the blank period from the transmission device to the reception device is necessary. It is not preferable to provide a signal line separate from the first or second signal line only to transmit the notification of the above-described transition in the system. Also, transmitting the notification related to the above-described transition via the second signal line in a command of a protocol of a serial bus standard such as $I^2C$ can also be considered. However, in general, the transmission and reception of image data and training data via, the first signal line are at a high speed, while the communication via the second signal line is at a low speed. Therefore, at the timing at which the reception device receiving the notification indicating the transition from the blank period to the active period via the second signal line ends clock training, the active period already operates and the image data is transmitted from the transmission device to the reception device via the first signal line. When this state occurs, image data until a clock training end timing among the image data transmitted from the transmission device is not received normally by the reception device and a part of an image to be displayed by the image display device is lacking.

The present invention has been made to solve the above-described problem and an objective of the invention is to provide a transmission device and a reception device capable of suppressing a lack of image data reception by the reception device without providing a signal line separate from a first or second signal line only to transmit a notification of transition. Also, an objective of the invention is to provide a transmission/reception system including the transmission device and the reception device and an image display system including the transmission device, the reception device, and an image display device.

Solution to Problem

A transmission device of the present invention is a transmission device for transmitting serial data for which a timing of transition from a first level to a second level is in each unit period and which has information of a predetermined number of bits in the unit period starting from the transition timing to a reception device, the transmission device including: a first transmission unit configured to transmit training data for the reception device to perform clock training and image data as the serial data to the reception device; a second transmission unit configured to communicate with the reception device according to a first protocol in a first mode and communicate with the reception device according to a second protocol simpler than the first protocol in a second mode; and a transmission control unit configured to control the data transmission by the first transmission unit and the communication by the second transmission unit, Further, the transmission control unit causes the first transmission unit to transmit the image data in the first mode and causes the second transmission unit to transmit a mode switching notification for providing a notification of switching to the second mode when the switching to the second mode is performed, and the transmission control unit causes the first transmission unit to transmit the training data in the second mode and causes the second transmission unit to transmit a mode switching notification for providing a notification of switching to the first mode when the switching to the first mode is performed.

A reception device of the present invention is a reception device for receiving serial data for which a timing of transition from a first level to a second level is in each unit period and which has information of a predetermined number of bits in the unit period starling from the transition timing from a transmission device, the reception device including: a first reception unit configured to receive training data and image data as the serial data from the transmission device; and a second reception unit configured to communicate with the transmission device according to a first protocol in a first mode and communicate with the transmission device according to a second protocol simpler than the first protocol in a second mode. Further, in the reception device of the present invention, the first reception unit receives the image data in the first mode and performs switching to the second mode on the basis of a mode switching notification received by the second reception unit, and the first reception unit receives the training data to perform clock training on the basis of the training data in the second mode and performs switching to the first mode on the basis of a mode switching notification received by the second reception unit.

A transmission/reception system of the present invention includes the transmission device of the present invention and the reception device of the present invention. An image display system of the present invention includes the transmission device of the present invention, the reception device of the present invention; and an image display device configured to display an image on the basis of the image data acquired by the reception device.

Advantageous Effects of Invention

According to the present invention, it is possible to suppress a lack of image data reception by a reception device.

DESCRIPTION OF EMBODIMENTS

Hereinafter, embodiments of the present invention will be described in detail with reference to the accompanying drawings. The same elements in the description of the drawings are assigned the same reference signs and redundant description thereof will be omitted.

Figure 1:
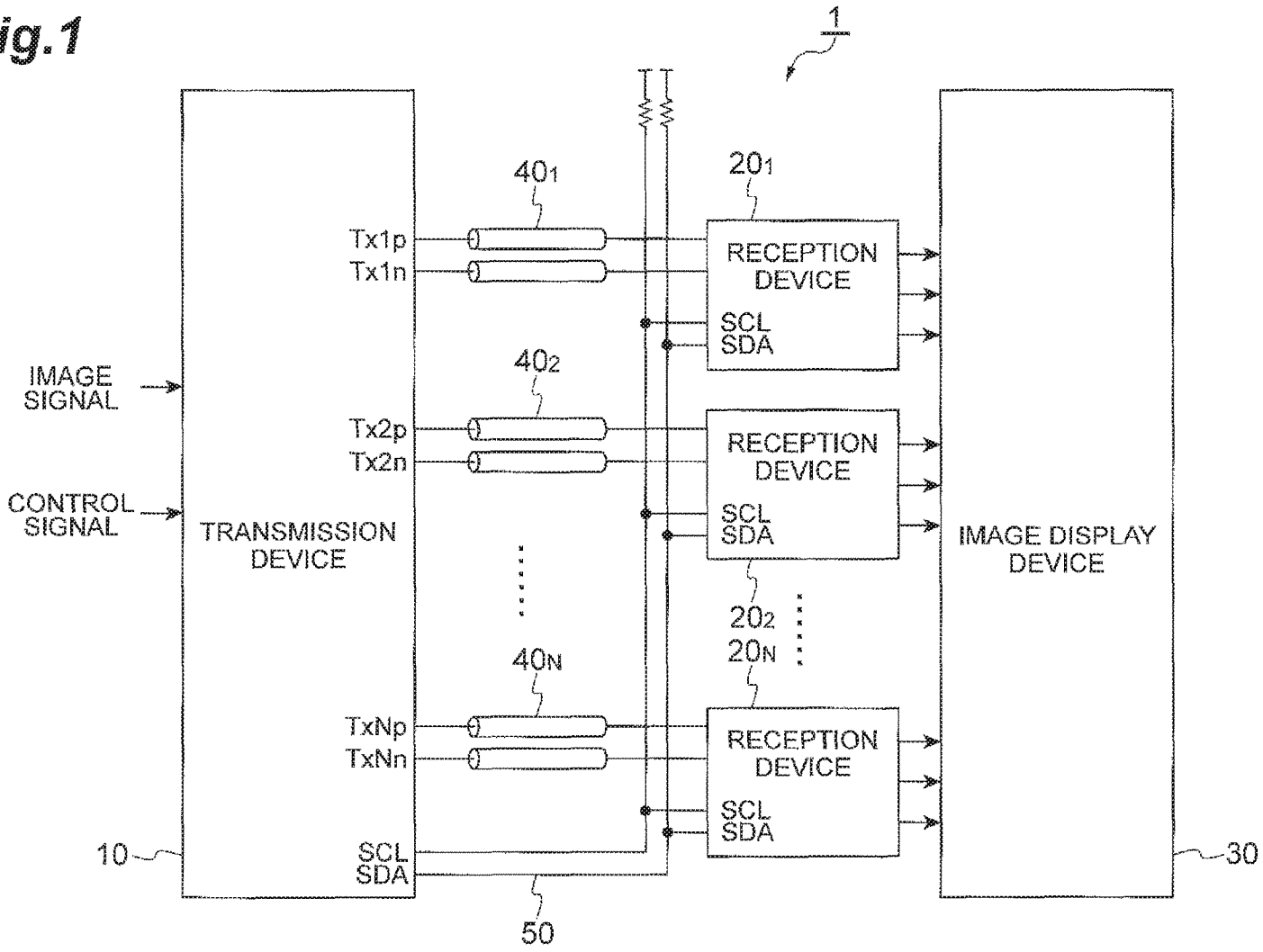
FIG. 1 is a diagram illustrating a schematic configuration of an image display system 1 of the present embodiment.

FIG. 1 is a diagram illustrating a schematic configuration of an image display system 1 of the present embodiment. The image display system 1 illustrated in FIG. 1 includes a transmission device 10, N reception devices $\mathbf{20}_1$ to $\mathbf{20}_N$, and an image display device 30. The transmission device 10 and the N reception devices $\mathbf{20}_1$ to $\mathbf{20}_N$ constitute a transmission/reception system of the present embodiment. Here, N is an integer greater than or equal to 2 and n shown below is each integer greater than or equal to 1 and less than or equal to N. In FIG. 1, the illustration of a drive unit and a signal line for vertical scanning of an image in the image display device 30 is omitted.

The transmission device 10 inputs an image signal and a control signal (control command) from an outside and transmits image data and control data as serial data to each of the N reception devices $\mathbf{20}_1$ to $\mathbf{20}_N$. The image data is serial data generated on the basis of the image signal. The control data is serial data generated on the basis of the control signal. The serial data is data in which a clock is embedded, a timing of transition from a first level to a second level is provided in each unit period, and the serial data has information of a predetermined number of bits in the unit period starting from the timing of transition. One of the first level and the second level is a high level and the other is a low level. The transition from the first level to the second level at the starting timing of each unit period corresponds to the clock.

For example, the control signal includes a signal indicating the polarity of the image data transmitted from each reception device $\mathbf{20}_n$ to the image display device 30, a signal indicating a start position of data writing to a register embedded in each reception device $\mathbf{20}_n$, a signal indicating a data header position during a blank period, and a signal indicating a frame start position. Also, the control signal also includes a training signal for each reception device $\mathbf{20}_n$ to perform clock training.

Each reception device $\mathbf{20}_n$ receives image data and control data arriving from the transmission device 10 through a first signal line $\mathbf{40}_n$. Each reception device $\mathbf{20}_n$ performs control of content indicated by received control data. Also, each reception device $\mathbf{20}_n$ transmits an image signal obtained by receiving the image data to the image display device 30. The image display device 30 is, for example, a liquid crystal panel, and displays an image on the basis of image signals transmitted from the reception devices $\mathbf{20}_1$ to $\mathbf{20}_N$.

The transmission device 10 and each reception device $\mathbf{20}_n$ are connected by the first signal line $\mathbf{40}_n$. Each signal line $\mathbf{40}_n$ transmits the serial data transmitted from the transmission device 10 to the reception device $\mathbf{20}_n$. Each signal line $\mathbf{40}_n$ may be physically one line or a pair of lines for transmitting differential data.

Also, the transmission device 10 and the reception devices $\mathbf{20}_1$ to $\mathbf{20}_N$ are connected by a second signal line 50, and can perform communication via the second signal line. This communication conforms to protocols of serial bus standards, for example, such as Inter-Integrated Circuit ($I^2C$) and Serial Peripheral Interface (SPI).

When the $I^2C$ standard is used as illustrated in FIG. 1, the second signal line 50 includes an SCL line through which a clock is transmitted and an SDA line through which data is transmitted. For example, the transmission device 10 can write data to a register embedded in each reception device $\mathbf{20}_n$ by performing communication according to a predetermined protocol via the second signal line 50. Each. reception device $\mathbf{20}_n$ can perform an operation according to the data written to the register.

Figure 2:
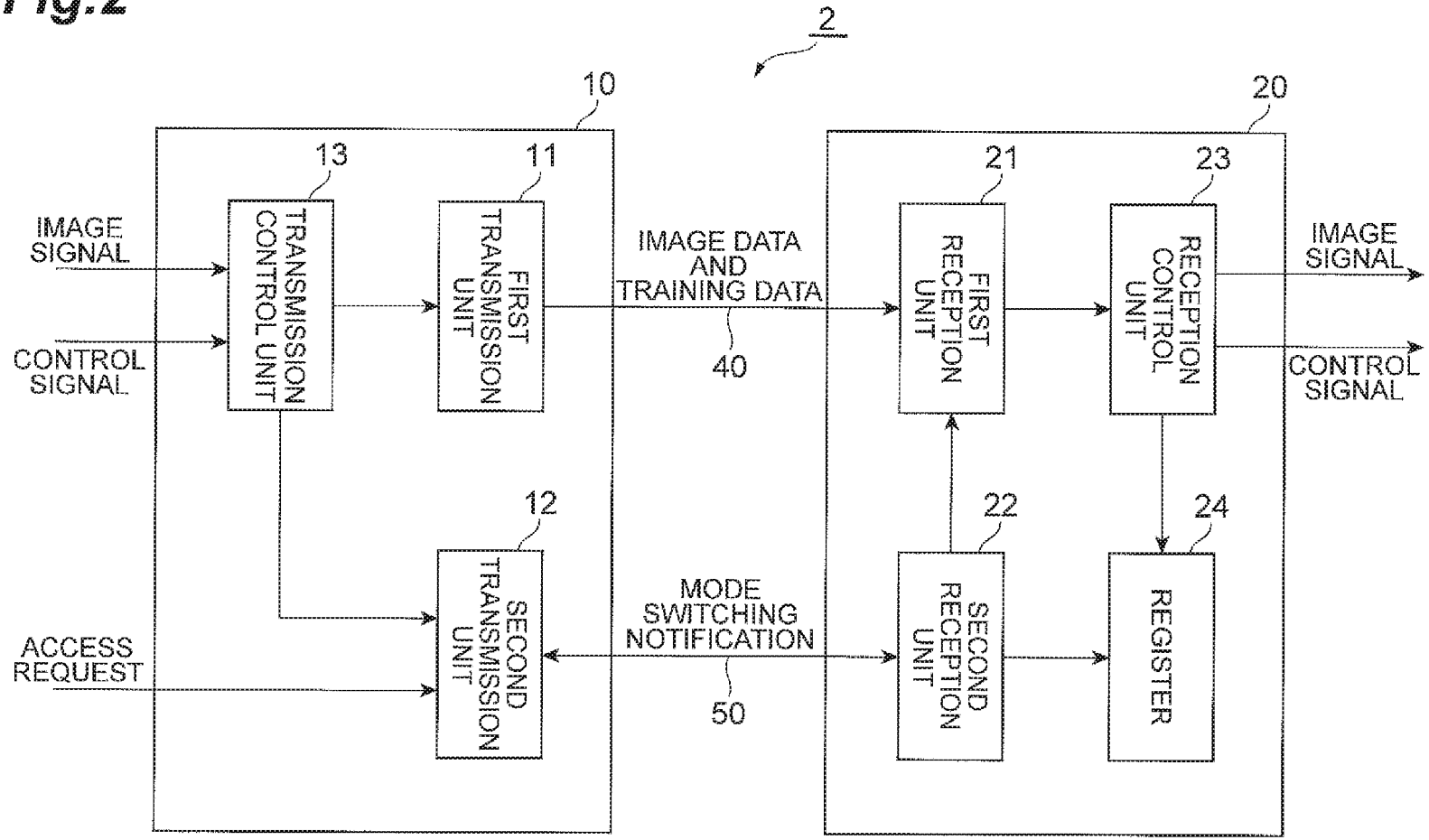
FIG. 2 is a diagram illustrating a configuration of a transmission/reception system 2 of the present embodiment.

FIG. 2 is a diagram illustrating a configuration of a transmission/reception system 2 of the present embodiment. In FIG. 2, any one reception device 20 among the N reception devices $\mathbf{20}_1$ to $\mathbf{20}_N$ is illustrated and a configuration part corresponding to the reception device 20 in the transmission device 10 is illustrated.

The transmission device 10 includes a first transmission unit 11, a second transmission unit 12, and a transmission control unit 13. The transmission control unit 13 controls data transmission by the first transmission unit 11 and communication by the second transmission. unit 12. The transmission control unit 13 inputs an image signal from an outside and outputs data packetized and encoded on the basis of the image signal. Also, the transmission control unit 13 inputs a control signal (control command) from the outside and outputs the data according to the control signal. The first transmission unit 11 serializes the data output from the transmission control unit 13 and transmits the serialized data to the reception device 20 via the first signal line 40. The second transmission unit 12 receives a request from the outside or the transmission control unit 13 and communicates with a second reception unit 22 of the reception device 20 via the second signal line 50 according to a predetermined protocol.

The reception device 20 includes a first reception unit 21, the second reception unit 22, a reception control unit 23, and a register 24. The first reception unit 21 receives control data and image data as serial data from the transmission device 10 via the first signal line 40. The first reception unit 21 de-serializes the received serial data and designates the de-serialized data as parallel data. The reception control unit 23 decodes the parallel data, further unpacketizes the decoded data, and acquires the image data. Also, the reception control unit 23 outputs a control signal (control command) on the basis of the received serial data. The second reception unit 22 communicates with the second transmission unit 12 of the transmission device 10 via the second signal line 50 according to a predetermined protocol. Data is written to the register 24 according to data reception by the first reception unit 21 or communication by the second reception unit 22. The data written to the register 24 is, for example, data to be used when the reception device 20 drives the image display device 30.

As control data to be transmitted from the first transmission unit 11 of the transmission device 10 to the first reception unit 21 of the reception device 20 via the first signal line 40, training data for the first reception unit 21 to perform clock training is included. The training data transitions from a first level to a second level at a start timing of each unit period and transitions from the second level to the first level only once during the unit period. The clock training is a process for optimizing a frequency and a phase of a clock for the first reception unit 21 of the reception device 20 to sample the serial data transmitted from the first transmission unit 11 of the transmission device 10 via the first signal line 40 and is performed on the basis of the training data received by the first reception unit 21 in the blank period.

Figure 3:
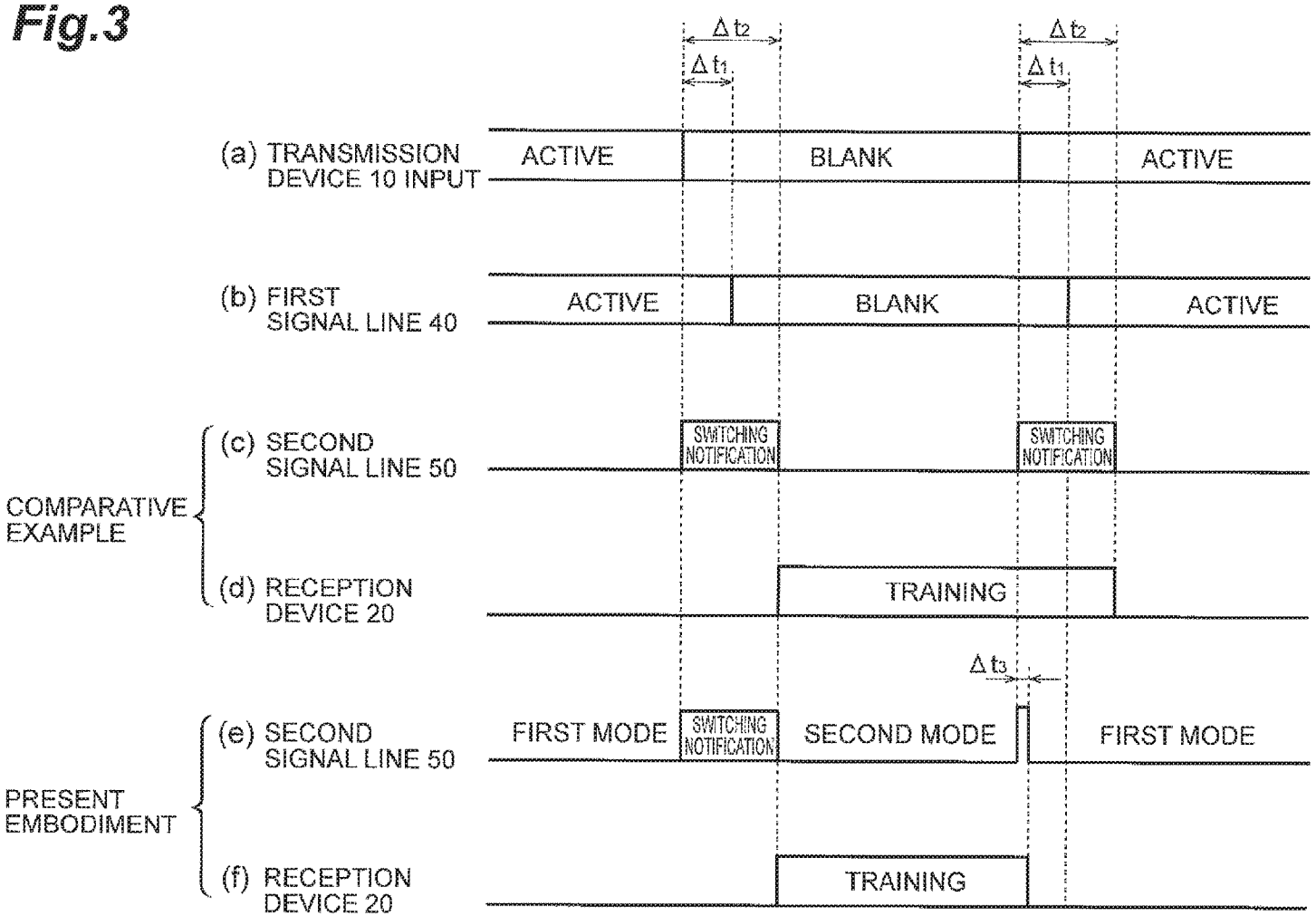
FIG. 3 is a diagram for describing a period of clock training in the transmission/reception system 2 of the present embodiment.

FIG. 3 is a diagram for describing a period of clock training in the transmission/reception system 2 of the present embodiment. A delay $\Delta t_1$ occurs from a switching timing between the active period and the blank period at the time of an input to the transmission device 10 illustrated in FIG. 3(*a*) to a switching timing between the active period and the blank period at the time of an output from the transmission device 10 to the first signal line 40 illustrated in FIG. 3(*b*).

In a comparative example, a delay $\Delta t_2$ occurs from a switching timing between the active period and the blank period at the time of an input to the transmission device 10 illustrated in FIG. 3(*a*) to a timing at which its switching notification is recognized in the reception device 20 after being transmitted from the second transmission unit 12 of the transmission device 10 to the second reception unit 22 of the reception device 20 via the second signal line 50 as illustrated in FIG. 3(*c*). Because the communication via the second signal line 50 conforms to, for example, protocols of serial bus standards such as $I^2C$ and SPI, the delay $\Delta t_2$ is longer than the delay $\Delta t_1$.

Therefore, in the comparative example, as illustrated in FIG. 3(*d*), at the timing at which the reception device 20 receives the switching notification and ends the clock training, the active period already operates and the image data is transmitted from the transmission device 10 to the reception device 20 via the first signal line 40. When this state occurs, image data, until a clock training end timing among the image data transmitted from the transmission device 10 is not received normally by the reception device 20 and a part of an image to be displayed by the image display device 30 is lacking.

On the other hand, in the present embodiment, there are a first mode and a second mode in relation to the communication between the second transmission unit 12 of the transmission device 10 and the second reception unit 22 of the reception device 20. The second transmission unit 12 of the transmission device 10 and the second reception unit 22 of the reception device 20 perform communication according to a first protocol in the first mode and perform communication according to a second protocol in the second mode, via the second signal line 50.

A mode switching notification for providing a notification of switching between the first mode and the second mode is transmitted from the second transmission unit 12 of the transmission device 10 to the second reception unit 22 of the reception device 20 via the second signal line 50. In the first mode, the image data is transmitted from the first transmission unit 11 of the transmission device 10 to the first reception unit 21 of the reception device 20 via the first signal line 40. In the second mode, the training data is transmitted from the first transmission unit 11 of the transmission device 10 to the first reception unit 21 of the reception device 20 via the first signal line 40.

The first protocol in the first mode may be a protocol of an existing serial bus standards such as $I^2C$ or SPI, a protocol similar to these protocols or a partially modified protocol. When $I^2C$ is adopted as the first protocol, second signal lines 50 include an SCL line through which the clock is transmitted and an SDA line through which data is transmitted. The transmission device 10 can first transmit an address to select any reception device 20 and transmit control data or the like to the selected reception device 20.

The second protocol in the second mode is based on a simpler procedure than in the first protocol and is operable at a high speed. For example, the second protocol may be a protocol in which data transmitted from the second transmission unit 12 of the transmission device 10 to the second reception unit 22 of the reception device 20 via the second signal line 50 may be shifted from a certain level to another level.

As illustrated in FIG. 3(*e*), the mode switching notification for providing a notification of switching from the first mode to the second mode starts from a timing of switching from the active period to the blank period at the time of an input to the transmission device 10 and is recognized in the reception device 20 after the delay $\Delta t_2$. After the recognition, the reception device 20 performs clock training on the basis of training data arriving at the first reception unit 21.

Also, as illustrated in FIG. 3(*e*), the mode switching notification for providing a notification of switching from the second mode to the first mode starts from a timing of switching from the blank period to the active period at the time of an input to the transmission device 10 and is recognized in the reception device 20 after the delay $\Delta t_3$ shorter than the delay $\Delta t_1$. After the recognition, the reception device 20 ends the clock training.

In the present embodiment, the active period is not reached at the timing at which the reception device 20 receiving the notification of the switching from the second mode to the first mode ends the clock training and then image data is transmitted from the transmission device 10 to the reception device 20 via the first signal line 40. Therefore, the first reception unit 21 of the reception device 20 can receive the image data transmitted from the transmission device 10 from its header normally.

Figure 4:
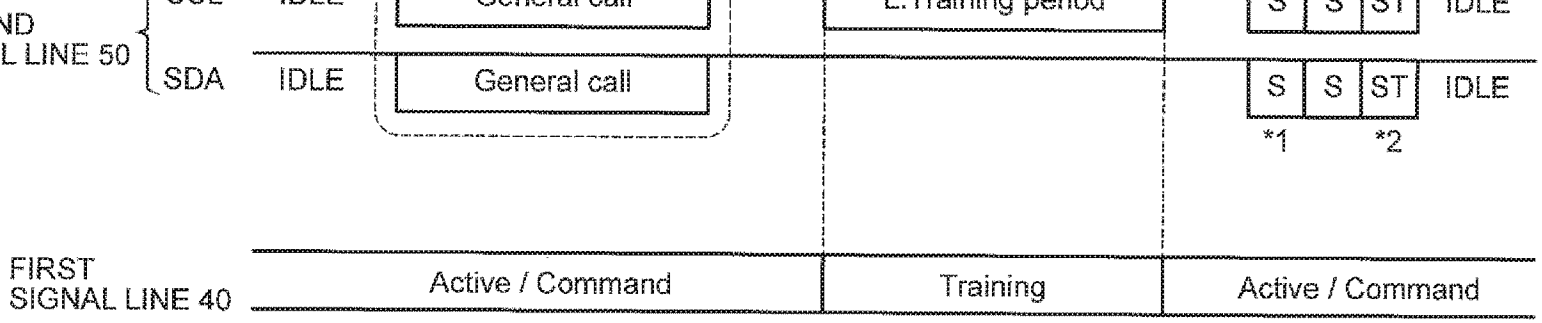
FIG. 4 is a diagram for describing a specific example of mode switching in the transmission/reception system 2 of the present embodiment.

FIG. 4 is a diagram for describing a specific example of mode switching in the transmission/reception system 2 of the present embodiment. In this example; $I^2C$ is adopted as the first protocol at the time of communication via the second signal line 50 in the first mode. A general call is used for the transmission device 10 to notify all reception devices 20 of switching from the first mode to the second mode according to the first protocol. When the mode becomes the second mode after this general call and data of the SCL line included in the second signal line 50 is shifted from the high level to the low level, the training data is transmitted from the first transmission unit 11 of the transmission device 10 to the first reception unit 21 of the reception device 20 via the first signal line 40 thereafter and the clock training is performed in the reception device 20.

The data of SCL line included in the second signal line 50 is shifted from the low level to the high level through communication according to the second protocol via the second signal line 50, so that the mode is switched to the first mode and the clock training in the reception device 20 ends. Also, data of the second communication line 50 is in two start conditions and one stop condition and communication by the first protocol via the second signal line 50 is possible.

Thus, in the present embodiment, in the first mode, image data is transmitted from the transmission device 10 to the reception device 20 via the first signal line 40 and a mode switching notification for providing a notification of switching to the second mode is transmitted from the transmission device 10 to the reception device 20 via the second signal line 50 according to the first protocol. Also, in the second mode, training data is transmitted from the transmission device 10 to the reception device 20 via the first signal line 40, clock: training is performed in the reception device 20 on the basis of the training data, and a mode switching notification for providing a notification of switching to the first mode is transmitted from the transmission device 10 to the reception device 20 via the second signal line 50 according to the second protocol that is simpler and faster than the first protocol. Therefore, because the reception device 20 can end the clock training before the image data is transmitted from the transmission device 10 to the reception device 20 via the first signal line 40, it is possible to receive the image data from its header normally and suppress a lack of image data reception.

REFERENCE SIGNS LIST

1 Image display system
2 Transmission/reception system
10 Transmission device
11 First transmission unit
12 Second transmission unit
13 Transmission control unit
20 Reception device
21 First reception unit
22 Second reception unit
23 Reception control unit
24 Register
30 Image display device
40 First signal line
50 Second signal line

The invention claimed is:

1. A transmission device for transmitting serial data for which a timing of a transition from a first level to a second level is in each unit period and which has information of a predetermined number of bits in the unit period starting from the timing to a reception device, the transmission device comprising:

a first transmitter configured to transmit training data for the reception device to perform clock training and image data as the serial data to the reception device;

a second transmitter configured to communicate with the reception device according to a first protocol in a first mode and communicate with the reception device according to a second protocol in a second mode; and a transmission controller configured to control transmission of the training data by the first transmitter and communication by the second transmitter, wherein the transmission controller is configured to control the first transmitter to transmit the image data in the first mode and to control the second transmitter to transmit a first mode switching notification configured to notify of switching to the second mode when the switching to the second mode is performed, wherein the transmission controller is further configured to control the first transmitter to transmit the training data in the second mode and to control the second transmitter to transmit a second mode switching notification configured to notify of switching to the first mode when the switching to the first mode is performed, and wherein the second mode switching notification is shorter than the first mode switching notification.

2. The transmission device according to claim 1, wherein the first mode switching notification comprises a general call, and wherein the second mode switching notification is formed by a shift of a level of a signal transmitted by the second transmitter during the second mode.

3. The transmission device according to claim 2, wherein the first transmitter is configured to transmit the training data on a first line, and wherein the second transmitter is configured to transmit the first mode switching notification and the second mode switching notification by a second line.

4. A reception device for receiving serial data for which a timing of a transition from a first level to a second level is in each unit period and which has information of a predetermined number of bits in the unit period starting from the timing from a transmission device, the reception device comprising:

a first receiver configured to receive training data and image data as the serial data from the transmission device; and a second receiver configured to communicate with the transmission device according to a first protocol in a first mode and communicate with the transmission device according to a second protocol in a second mode, wherein the first receiver is further configured to receive the image data in the first mode and to perform switching to the second mode based on a first mode switching notification received by the second receiver, wherein the first receiver is further configured to receive the training data instructing to perform clock training on the basis of the training data in the second mode and to perform switching to the first mode on the basis of a second mode switching notification received by the second receiver, and wherein the second mode switching notification is shorter than the first mode switching notification.

5. The reception device according to claim 4, wherein the first receiver is further configured to, according to the second mode switching notification being shorter than the first mode switching notification, to switch from the second mode to the first mode faster than to switch from the first mode to the second mode.

6. A transmission and a reception system comprising:

the transmission device according to claim 1; and a reception device for receiving serial data for which a timing of the transition from the first level to the second level is in each unit period and which has information of the predetermined number of bits in the unit period starting from the transition timing from the transmission device, the reception device including:

a first receiver configured to receive the training data and the image data as the serial data from the transmission device; and a second receiver configured to communicate with the transmission device according to a first protocol in the first mode and communicate with the transmission device according to a second protocol in the second mode, wherein the first receiver receives the image data in the first mode and performs switching to the second mode on the basis of the first mode switching notification received by the second receiver, and wherein the first receiver receives the training data to perform clock training on the basis of the training data in the second mode and performs switching to the first mode on the basis of the second mode switching notification received by the second receiver.

7. An image display system comprising:

the transmission and the reception system according to claim 6; and an image display device configured to display an image on the basis of the image data acquired by the reception device.

* * * * *